United States Patent [19]

Jacobs

[11] Patent Number: 4,782,550

[45] Date of Patent: Nov. 8, 1988

[54] AUTOMATIC SURFACE-TREATING APPARATUS

[75] Inventor: Stephen Jacobs, Arcata, Calif.

[73] Assignee: Von Schrader Company, Racine, Wis.

[21] Appl. No.: 155,312

[22] Filed: Feb. 12, 1988

[51] Int. Cl.[4] ..... A47L 9/00

[52] U.S. Cl. ..... 15/320; 15/319; 15/339; 15/340; 180/79; 180/203

[58] Field of Search ..... 15/320, 340, 339, 319; 180/7.2, 79, 199, 203

[56] References Cited

U.S. PATENT DOCUMENTS

| | | | |
|---|---|---|---|
| 1,935,158 | 11/1933 | Lumley | 15/319 |
| 3,142,350 | 7/1964 | Flint | 180/203 |
| 3,713,505 | 1/1973 | Muller | 15/319 X |
| 4,114,711 | 9/1978 | Wilkins | 15/319 X |
| 4,503,581 | 3/1985 | Early | 15/340 X |

FOREIGN PATENT DOCUMENTS

| | | | |
|---|---|---|---|
| 336725 | 10/1930 | United Kingdom | 180/203 |

*Primary Examiner*—Chris K. Moore

*Attorney, Agent, or Firm*—Peter N. Jansson Ltd.

[57] ABSTRACT

Improved automatic surface-treating apparatus of the type supported by and traversing a horizontal surface unattended. The apparatus includes mobility members for movement in a principal direction and side-step members having rotational axes a given distance above the surface. Each side-step member has a first sector with a far periphery spaced from its axis by more than the given distance, and a second sector with a near periphery spaced from its axis by less than the given distance. This arrangement allows a single rotation of the side-step members to accurately lift and move the apparatus laterally through a predetermined distance, to a new surface-treatment path.

19 Claims, 4 Drawing Sheets

AUTOMATIC SURFACE-TREATING APPARATUS

FIELD OF THE INVENTION

This invention is related generally to automatic apparatus for the treatment of horizontal surfaces and, more particularly, to surface-treating apparatus of the type supported by, traversing, and treating horizontal surfaces, primarily carpeted floors, unattended by an operator.

BACKGROUND OF THE INVENTION

Various devices and methods have been developed in the past for the treatment of horizontal surfaces such as floors. Improving and accelerating floor cleaning operations, particularly by various kinds of automation, have been concerns as long as floors have been cleaned. Because floor-cleaning and similar surface-treating operations are rather labor intensive, substantial cost savings may be available from automation.

With the explosive growth in the use of tack-down carpets in recent years, improving the quality and efficiency of carpet-cleaning operations has become a particular concern. While caring for carpets is generally no more costly than caring for hard floor, carpet care presents a number of unique problems due to the nature of the carpet surface.

For example, a carpeted surface is fibrous, thick and a bit irregular when compared to a flat hard floor; the path of a wheeled device traversing carpet can be affected by these qualities. And, carpet cleaning other than simple vacuuming can involve a number of steps complicating automation.

In the past, a number of devices referred to as "automatic" have been developed for treatment of horizontal surfaces, including in some cases carpets. Many of these devices are "automatic" in the sense that they interact with the surface beneath them without the direct manipulation of brushes, scrubbers, or nozzles by operators, even though operators constantly attend such devices by pushing or guiding them.

Some prior automatic floor-treating devices are "automatic" in the additional sense that they may operate unattended, that is, without an operator beside them to push or otherwise guide them. Among such prior devices are those disclosed in U.S. Pat. Nos. 4,503,581 (Early) and 1,935,158 (Lumley). Such devices traverse the floor under their own power and control. This invention is an improvement in surface-treating equipment of this more fully automatic type, and most specifically an improvement in carpet-cleaning equipment.

Automatic surface-treating equipment of the prior art has a number of problems and shortcomings. More specifically, improved automatic carpet-cleaning equipment is needed.

Automatic carpet-cleaning or floor-cleaning devices typically perform a number of functions as they pass over the carpet or other floor surface to be cleaned. Such functions may include applying a cleaning composition, scrubbing in some manner, and removing the dirt and used cleaning composition.

Such multiple steps may be carried out in a single pass or more then one pass along a first path. After the first path has been treated, it is necessary to repeat the same step or steps along a second path which is parallel to the first path. It is very important that the second path be contiguous with the first path so that there are no neglected strips between the paths.

In particular, there is a tendency for such apparatus to move over a floor in a somewhat erratic or insufficiently controlled manner, particularly when moving from one straight path to the adjacent, or next straight path. Some prior devices have means for lateral movement to a new parallel path. However, such devices are complex in construction and by their nature may be prone to inaccurate movement. Successful treatment of large surface areas without leaving gaps is most difficult. In carpet cleaning operations, it is particularly important that gaps between cleaning paths be avoided.

Some prior automatic unattended devices for treating horizontal surfaces are by their nature suited primarily to use on hard surfaces. The irregularity of carpet surfaces complicates lateral movement. Improved equipment is used for accurate traversing of carpeted surfaces during automatic cleaning operations.

Automatic carpet-cleaning devices, because of the many steps typically necessary as mentioned above, require considerable space for the carpet-cleaning elements and assemblies which must be included. Certain automatic devices of the prior art, because of the apparatus they require for floor-traversing and side-stepping movements, do not provide much space on the for carpet-cleaning elements and assemblies. Improved equipment is needed which provides not only accuracy in movements, including side-stepping movements, but ample room for the elements and assemblies needed for thorough carpet cleaning.

There has been a long-standing need for practical, easily usable and programmable surface-treating apparatus which can dramatically cut labor costs in operations such as carpet cleaning. There is a need for equipment with improved accuracy in its surface-traversing movements even on surfaces such as carpets.

OBJECTS OF THE INVENTION

It is an object of this invention to provide an improved automatic surface-treating apparatus overcoming some of the problems and shortcomings of the prior art, including those mentioned above.

Another object of this invention is to provide an improved fully automatic surface-treating device which can cut labor costs in tasks such as carpet cleaning.

Another object of this invention is to provide an improved automatic surface-treating apparatus having accurate surface-traversing movements even though unattended by an operator.

Another object of this invention is to provide an improved surface-treating apparatus which can accurately side-step from one surface-treatment path to the next.

Another object of this invention is to provide an improved automatic surface-treating apparatus which is programmable by an operator such that it properly carries out carpet-cleaning operations or other surface-treating operations.

These and other important objects will be apparent from the descriptions of this invention which follow.

SUMMARY OF THE INVENTION

This invention is an automatic surface-treating apparatus of the type supported by and traversing a horizontal surface unattended. The invention is an improvement which overcomes shortcomings of the prior art.

More specifically, the invention is a simple device which has an inherently accurate side-stepping ability; this provides improved accuracy in its surface-traversing movements. The device is also simple in construction such that it provides ample space for surface-treating elements and assemblies, such as those necessary for carpet cleaning. The invention is particularly useful as an automatic unattended carpet-cleaning apparatus.

The automatic surface-cleaning apparatus of this invention includes: a frame; mobility members such as wheels or tracks on the frame which are rotatable about axes extending in a first horizontal direction; means on the frame for treating the surface as the apparatus automatically traverses the surface; and side-step members on the frame which are rotatable about horizontal axes oriented transverse to the first direction and located a given distance about the surface.

Each side-step member has a first sector and a second sector, both of which are important to the manner in which the invention operates. This first sector has what is referred to herein as a far periphery which is spaced from its axis by more than the given distance, that is, by more than the distance by which the side-step axes are above the surface on which the apparatus is supported. The second sector, in contrast, has what is referred to herein as a near periphery, the near periphery being spaced from its axis by less than the aforementioned given distance.

This configuration of the side-step members and the spacing of their axes a given distance above the surface cause the rotation of the side-step members to lift and move the apparatus laterally by a predetermined distance each time they rotate a full turn. As soon as the so-called far peripheries of the side-step members engage the surface, the entire apparatus is gently and accurately lifted so that the main wheels (or other mobility members) leave the surface and the side-step members replace them as support for the apparatus.

The continued turning of such side-step members moves the apparatus sideways by an amount equal to the circumferential lengths of the far peripheries, after which the apparatus is lowered gently until its main wheels (or other mobility members) again bear the weight of the apparatus. The lateral movement provided by such side-step members is very accurate. The extent of such lateral movement may be coordinated with the width of the surface-treating elements of the apparatus, so that no gaps in coverage occur during a surface treatment involving many parallel paths of movement of the surface-treating apparatus.

In preferred embodiments of this invention, the side-step members are oriented such that their axes of rotation are perpendicular to the rotation axes of the mobility members. There are preferably four side-step members in a substantially rectangular arrangement.

The side-step members preferably have congruent profiles and center points, such that the directional orientation of the apparatus is maintained during lateral movement caused by rotation of such members. A single drive is preferably linked to all of the side-step members. This helps to maintain the desired directional orientation of the apparatus during its lateral movement.

The side-step members are preferably cut-off circular wheels. More specifically, their first sector far peripheries extend along a substantially circular path and their second sector near peripheries depart from such circular path. In a highly preferred embodiment, in profile, the near periphery of each such cut-off wheel follows a chord to close the circular path of the far periphery. Thus, the near periphery is substantially flat. When the side-step members are not in use, such flat near peripheries are parallel to the surface. The cut-off wheels preferably have far peripheries which extend along an arc of at least 180 degrees.

In preferred embodiments, the side-step members have far peripheries of length less than the width of the surface-contact members of the apparatus. This allows surface-treatment over multiple parallel paths without gaps, as described above. That is, one turn of the side-step members causes lateral movement of the apparatus to a parallel position not beyond the path last treated.

The mobility members are preferably wheels, as earlier noted, and include at least one drive wheel. A reversible first drive motor is linked to at least one of the drive wheels (or other mobility members), and a preferably reversible second drive motor is linked to the cut-off wheels (or other side-step members). The drive motors are preferably geared motors.

A control means controls the operation of the dirve motors. The control means is programmable such that movements along surface-treatment paths and then to subsequent parallel paths may be set. That is, the path length and apparatus speed may be set before the operation starts and are dictated by the setting of an on-board system. A control panel is included on the apparatus, such panel positioned for easy setting by an operator prior to the start of surface-treating operations. The control panel preferably includes means for digital programming of the apparatus.

This invention is particularly useful for the cleaning of carpets. The device illustrated herein is an automatic carpet-cleaning apparatus. A particularly preferred carpet-cleaning apparatus includes: means on the frame for applying foam to carpet on the surface; a brush movably mounted with respect to the frame in position to stroke the foam through the carpet to loosen carpet soil; means secured to the frame in position adjacent to the brush to vacuum the foam and loosened carpet soil from the carpet; and at least one cleaning drive means, preferably another motor, to drive one or more of the foam applying means, brush and vacuum means. Foam cleaning using such a device has been found to be a particularly effective method for automatic unattended carpet cleaning.

In such an apparatus, the programmable control means is used not only to control the movements of the apparatus across the carpet being cleaned but to control operation of the carpet-cleaning devices as well. Thus, the control means controls several motors used for at least three different purposes. Such control means also can be used to control the flow of cleaning composition by means of solenoid valves or the like.

This sort of control allows improvement not only in efficiency of carpet-cleaning operations, but in their thoroughness. Adequate amounts of cleaning composition and adequate time for cleaning steps can be imposed.

DETAILED DESCRIPTIONS OF PREFERRED EMBODIMENTS

The figures illustrate an automatic surface-treating apparatus 10, which is an automaic carpet cleaner in accordance with a preferred embodiment of this invention.

Figure 1:
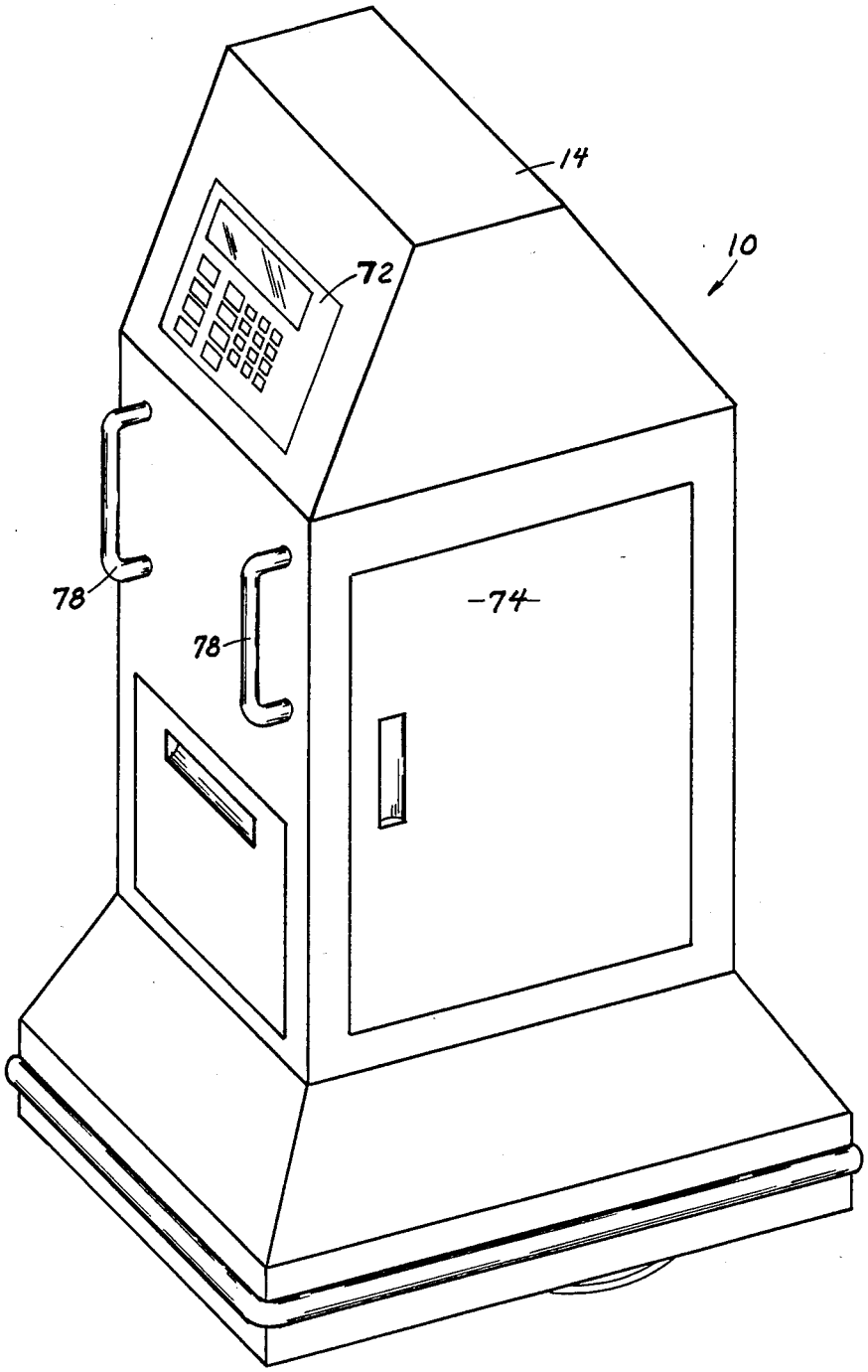
FIG. 1 is a perspective view of a preferred automatic carpet-treating apparatus in accordance with this invention.
Figure 3:
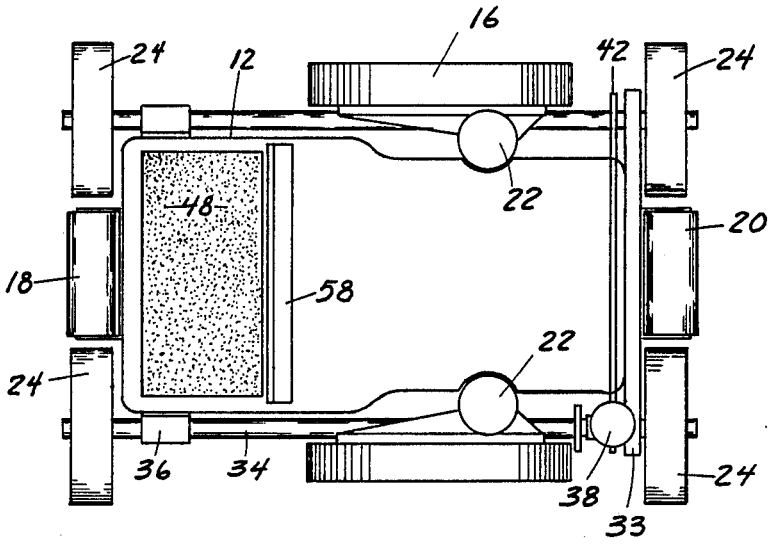
FIG. 3 is a top plan view of FIG. 2.
Figure 2:
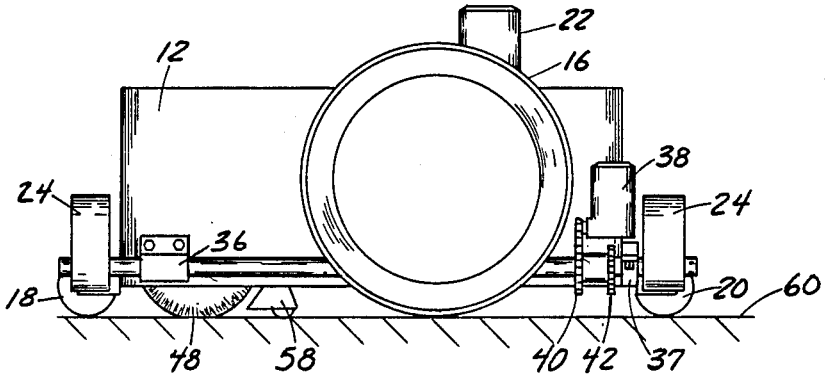
FIG. 2 is a fragmentary side elevation of the device in FIG. 1 with the shroud removed and other functional elements removed for improved clarity.

As illustrated in FIGS. 2–4, 6 and 7, automatic carpet-cleaning apparatus 10 includes a frame 12 which is a box-like rectangular metal band with open top and bottom. Each of the functional elements and assemblies of surface-treating apparatus 10 are secured directly or indirectly to frame 12. Such functional elements and assemblies are then covered by a shroud 14, as shown in FIG. 1, which is secured to frame 12 by means not shown.

Automatic carpet-cleaning apparatus 10 includes a set of mobility members by which apparatus 10 rolls during carpet-cleaning operations. The mobility members include a pair of large drive wheels 16 rotatably secured to frame 12 for rotation about a principal drive axis. Other mobility members include front and rear balance rollers 18 and 20, each of which rotates about an axis parallel to the principal drive axis. All of such axes extend in a first horizontal direction and during carpet-cleaning operations the main movement of automatic carpet cleaner 10 is either forward or reverse in a direction 90 degrees to such axes.

Such movement is imparted to carpet-cleaning apparatus 10 by a pair of reversible geared drive motors 22, each of which is linked by gears (not shown) to one of the drive wheels 16. Drive motors 22 are actuated together for straight-line movement of automatic carpet cleaner 10, either in a forward direction or a reverse direction as dictated by a control means. Drive motors 22 can be operated at slightly different rates from one another in response to sensors (not shown), in order to keep carpet-cleaning apparatus 10 moving in a straight line. While a pair of drive motors is preferred for drive wheel 16, a single drive motor driving both wheels 16 is an alternative.

A set of four side-step members 24 are rotatably secured with respect to frame 12 at positions near the four corners of frame 12. Side-step members 24 are all exactly congruent, that is, identical to each other in every dimension and in the location of their center points. Side-step members 12 are what will be referred herein for convenience as "cut-off wheels."

Cut-off wheels 24 are oriented 90 degrees offset from the orientation of drive wheels 16, and are rotatable about horizontal axes which are set at 90 degrees to the principal drive axes previously mentioned. The horizontal axes of cut-off wheels 24 are each positioned a first reference distance above surface 60, the surface on which automatic carpet-cleaning 10 rests.

Cut-off wheels 24 each have a first sector 26 with a far periphery 28 which is spaced from the axis of such cut-off wheel by more than the first reference distance. Each cut-off wheel 24 also has a second sector 30 with a near periphery 32 which is spaced from such axis by less than the first reference distance. This shape for each cut-off wheels 24 and the fact that cut-off wheels 24 act in unison allow cut-off wheels 24 to either be in contact or not in contact with surface 60.

By a single 360-degree rotation of cut-off wheels 24, carpet-cleaning apparatus 10 is lifted such that drive wheels 16 and front and rear balance rollers 18 and 20 are above surface 60 and apparatus 10 is moved laterally by a predetermined distance equal to the equal lengths of far peripheries 28. Such side-stepping motion will be described hereafter in greater detail.

Each cut-off wheel 24 is substantially circular except for its near periphery 32 in its second sector 30. Thus, first sector far periphery 28 extends along a substantially circular path and second sector near periphery departs from such circular path. Indeed, in profile, each near periphery 32 follows a chord of the circle to close the substantially circular path of far periphery 28. Thus, near periphery 32 is a substantially flat surface. When cut-off wheels 24 are not performing their side-stepping function, they are held in an orientation such that flat surfaces 32 are substantially parallel to and spaced from surface 60. This is shown best in FIGS. 2 and 4–6.

Far peripheries 28 of cut-off wheels 24 extend through arcs of about 220 degrees. Far peripheries with arcs in excess of 180 degrees are highly preferred. It is essential, of course, that flat surfaces 32 be spaced enough above the carpet surface to avoid any interference with such surface or, more specifically, with the carpet pile. It is also essential that, when cut-off wheels 24 have been rotated such that they are supporting apparatus 10, drive wheels 16 and front and rear balance rollers 18 and 20 be enough above the carpet to avoid interference during side-stepping lateral movements of apparatus 10.

Figure 5:
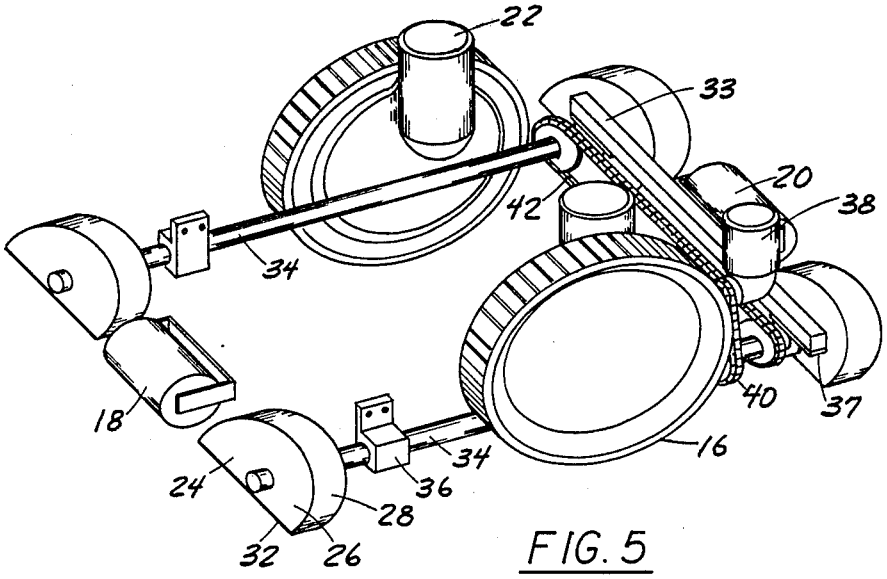
FIG. 5 is a fragmentary perspective view of FIG. 4, illustrating the surface-traversing elements.

As shown best in FIG. 5, pairs of cut-off wheels 24 are affixed to opposite ends of two rods 34. Each of the rods 34 is rotationally supported in a pair of bearings, including a bearing 36 secured to the side of frame 12 and a bearing 37 secured to a bar 33 which is affixed to frame 12. Rotation of rods 34 within such bearings causes rotation of cut-off wheels 24.

Such rotation is imparted to all four cut-off wheels 24 by a single drive motor 38. Cut-off wheel drive motor 38 is a geared motor which is secured to frame 17. Geared motor 38 turns one of the rods 34 through a sprocket-chain linkage 40. Another sprocket-chain linkage 42 links the two rods 34 such that they turn in unison in response to the operation of cut-off wheel drive motor 38.

Such unison operation of all four cut-off wheels 24 allows the directional orientation of carpet-cleaning apparatus 10 to be maintained during the lateral motion which is imparted to apparatus 10 by rotation of such cut-off wheels. Cut-off wheel drive motor 38 is reversible, such that cut-off wheels 24 may be rotated in one direction for lateral movement to the right and in the other direction for lateral movement to the left.

Control of the operation of cut-off wheels 24, including coordination with the operation of drive wheels 16, will be described hereafter in greater detail. First however, the surface-treating devices shown in the drawings will be described. In this case, such devices are for carpet-cleaning, and, more specifically, carpet cleaning using a foam-cleaning method.

Figure 4:
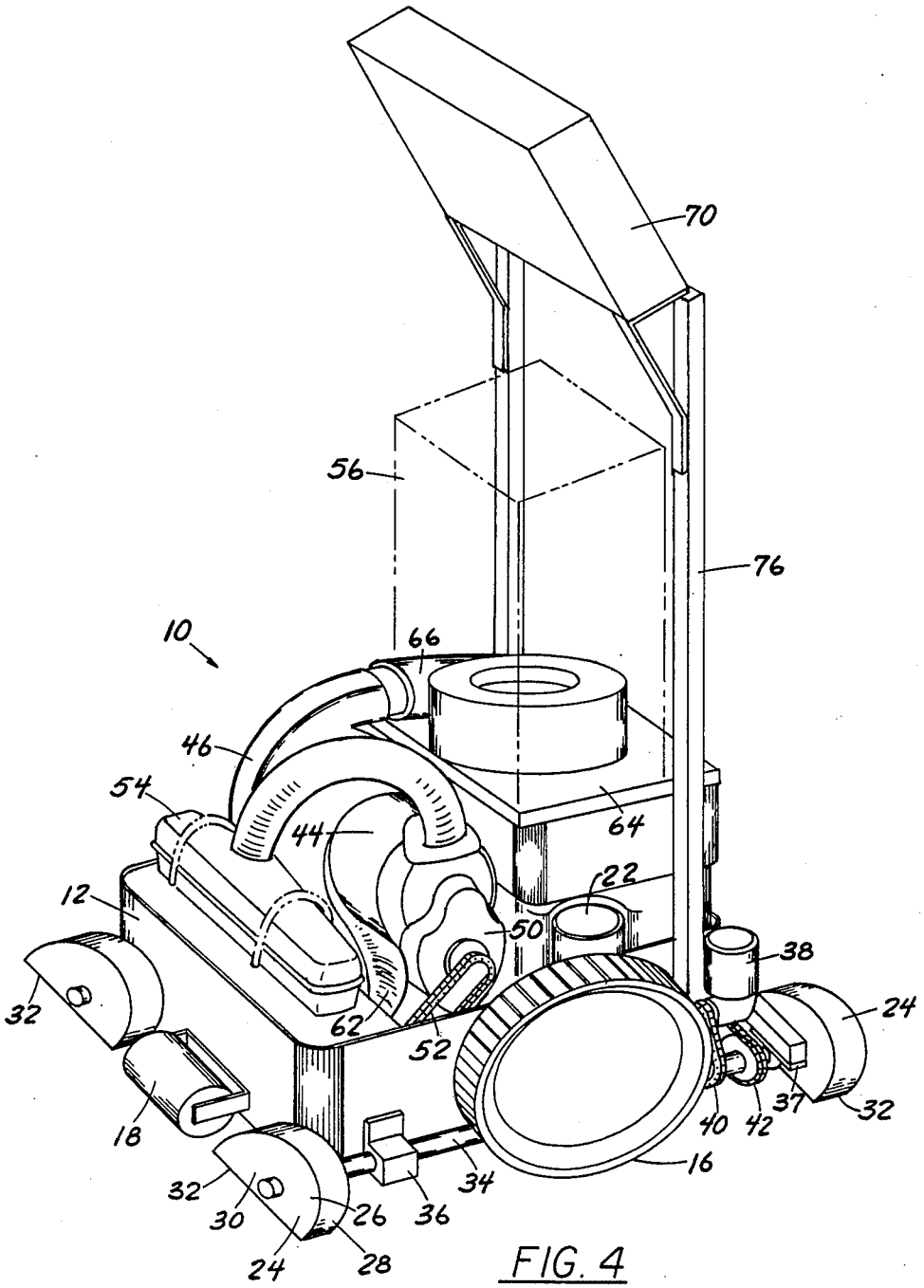
FIG. 4 is a perspective view with the shroud removed, taken from a position behind the apparatus as shown in FIG. 1.

As shown best in FIG. 4, the combination of elements and assemblies of the carpet-cleaning means include: a cleaning drive motor 44 which is secured to a cross member (not shown) of frame 12; a blower 46 which is secured to the drive shaft of motor 44; a rotary brush 48 which is rotatably supported between the side walls of frame 12; a gear box 50 which includes a reduction gear arrangement which links motor 44 with a sprocket-chain linkage 52 for rotating brush 48; a foam-producing gear arrangement which links motor 44 with a sprocket-chain linkage 52 for rotating brush 48; a foam-producing unit 54 secured to frame 12 immediately above rotary brush 48; a removable liquid-supply tank 56 (shown in phantom lines) which supplies a foamable liquid to foam-producing unit 54 by means of a hose (not shown); a solenoid valve (not shown) in the liquid supply line to start and stop the flow of carpet-cleaning liquid; a vacuum shoe 58 secured with respect to frame 12 near surface 60 at a position immediately behind rotary brush 48; a vacuum hose 62 leading from vacuum shoe 58 to blower 46; a removable waste collection unit 64 supported toward the back of apparatus 10; and a waste transmission hose 66 extending from blower 46 to collection unit 64.

The operation of the carpet-cleaning means is as follows:

First, cleaning drive motor is actuated to start rotation of brush 48. Then, liquid from supply tank 56 reaches foam-producing unit 54, the details of which need not be described, upon opening of the solenoid valve, and a foam reaches the carpet beneath apparatus 10 in the area of brush 48. Foam production is aided by exhaust air from drive motor 44 which is transmitted from motor 44 to foam-producing unit 54 by means of hose 68.

The rotation of brush 48 in a counter-clockwise direction (as viewed in FIG. 4), strokes the foam into and through the carpet pile to quickly remove dirt from carpet fibers. After foam application has begun, forward movement of apparatus 10 may begin. As this occurs, the vacuum produced in vacuum shoe 58 by blower 46 pulls the foam and dirt from the carpet, between the carpet fibers, and transmits such foam and dirt through vacuum hose 62, blower 46, and waste transmission hose 66 to waste collection unit 64. Waste collection unit 64 includes a defoaming agent, which allows the waste to collect as a dirty liquid in waste collection unit 64.

A variety of other carpet-cleaning devices could be used instead of the device which is illustrated. Or, the automatic unattended surface-treating apparatus of this invention can be used for other purposes.

The operations of drive motors 22, drive motor 38, drive motor 44, and the aforementioned solenoid valve are all controlled and coordinated by a programmable controller 70, shown in FIGS. 1 and 4. Controller 70 includes electronic timers, switches, memory devices and sequencers, all as widely available and well-known. An operator can program the movements and operations of apparatus 10 and can create, revise, store and use several different operational sequences.

In the illustrated embodiment, when apparatus 10 is turned on, cleaning drive motor 44 operates continuously, turning rotary brush 48 and providing the necessary vacuum. In one sequence of events, a signal will be sent to the aforementioned solenoid to begin the flow of liquid to foam-producing unit 54. After some foam has reached the carpet, a program signal from controller 70 will operate drive motors 16 so that automatic carpet-cleaning apparatus 10 moves in a forward direction. As this occurs, vacuum shoe 58 will remove foam and dirt from the carpet and foam will continue to be applied by means of foam-producing unit 54 and rotary brush 48.

Forward movement will continue for a programmer distance which has been set in controller 70. The production of foam can be cut off by closing of the solenoid valve shortly before forward movement ends such that all or substantially all of the foam and dirt will be removed before forward motion stops. Then, controller 70 will send another signal to drive motors 22, causing it to operate in the reverse direction such that apparatus 10 retraces its path. During such retracing movement, the vacuum unit continues to operate removing any remaining foam from the carpet.

Figure 7:
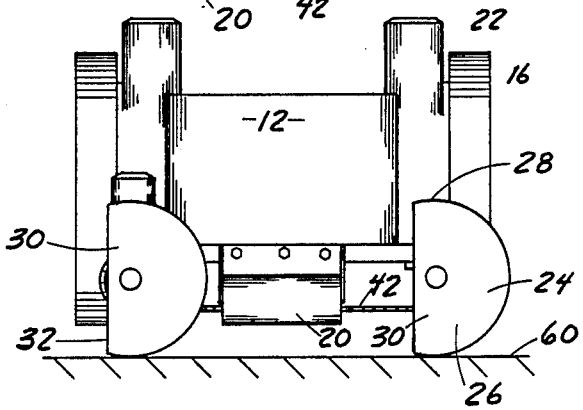
FIG. 7 is another right-side elevation as in FIG. 6, but illustrating the apparatus during a side-stepping motion.

After such reverse movement for a programmed distance equal to the forward movement, control unit 70 will stop the reverse operation of drive motors 22 and actuate cut-off wheel drive motor 38. Opertion of drive motor 38 wil cause cut-off wheels 24 to make one full revolution in one direction. During such revolution, far peripheries 28 of cut-off wheels 24 will engage surface 60, thus lifting drive wheels 16 and front and rear balance rollers 18 and 20 from surface 60 such that apparatus 10 is supported entirely by cut-off wheels 24. This movement is illustrated in FIG. 7. Continued rotation moves apparatus 10 laterally by a distance equal to the circumferential lengths of far peripheries 28.

Figure 6:
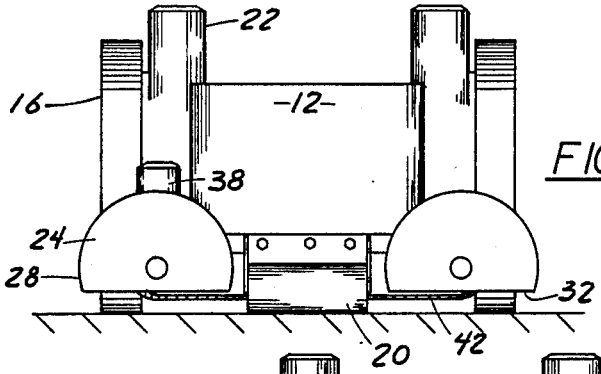
FIG. 6 is a right-side elevation of FIG. 2.

As the one full rotation of cut-off wheels 24 ends, apparatus 10 will be lowered until drive wheels 16 and front and rear balance rollers 18 re-engage surface 60, as illustrated in FIG. 6. The length of far peripheries 28 and the width of the cleaning path, that is, the width of rotary brush 48, are chosen such that lateral movement of apparatus 10 will not move brush 48 beyond the edge of the path which has been cleaned during a first cleaning stroke. After apparatus 10 has been moved, as described, the sequences already described can be repeated, thus causing apparatus 10 to clean carpet in a slightly-overlapping parallel path adjoining the first path of cleaning.

Programmable controller 70 includes a control panel 72 with control buttons allowing digital programming. Thus, automatic carpet-cleaning apparatus 10 can readily be programmed. Control panel 72, as illustrated in FIG. 4, is supported by upright structural members 76. Also attached to upright structural members 76 are a pair of handles 78 which may be used for manual adjustment of the position of automatic carpet-cleaning apparatus 10, as necessary.

Referring again to FIG. 1, it can be seen that shroud 14 includes a door 74 which may be opened to provide access to internal elements. In particular, removel of door 74 allows easy removal and replacement of liquid supply tank 56 and waste collection unit 64. The entire shroud can be removed easily, when servicing is necessary.

The apparatus of this invention can be made using materials and devices which are well-known and available to those skilled in the art.

While the principles of this invention have been described in connection with specific embodiments, it should be understood clearly that these decriptions are made only by way of example and are not intended to limit the scope of the invention.

I claim:

1. Automatic surface-treating apparatus of the type supported by and traversing a horizontal surface unattended, comprising:

a frame;

mobility members on the frame rotatable about axes extending in a first horizontal direction;

means on the frame fo treating the surface as the apparatus traverses the surface;

side-step members on the frame rotatable about horizontal axes transverse to the first direction and a given distance above the surface, each side-step member having:

a first sector with a far periphery spaced from its axis by more than the given distance, and a second sector with a near periphery spaced from its axis by less than the given distance;

whereby rotation of the side-step members will lift and move the apparatus laterally a predetermined distance.

2. The automatic surface-treating apparatus of claim 1 wherein the axes of side-step member rotation are perpendicular to the rotation axes of the mobility members.

3. The automatic surface-treating apparatus of claim 1 wherein there are four side-step members in a substantially rectangular arrangement.

4. The automatic surface-treating apparatus of claim 1 wherein the side-step members have congruent profiles and center points, whereby the directional orientation of the apparatus is maintained during lateral movement caused by rotation of such members.

5. The automatic surface-treating apparatus of claim 4 further including a single side-step drive unit and means connecting such drive unit to all side-step members, whereby the directional orientation of the apparatus is maintained during laterl movement caused by rotation of such members.

6. The automatic surface-treating apparatus of claim 4 wherein, in the side-step member profile, the first sector far periphery extends along a substantially circular path and the second sector near periphery departs from such circular path.

7. The automatic surface-treating apparatus of claim 6 wherein, in profile, the near periphery follows a chord to close the substantially circular path such that the near periphery is substantially flat and, when the side-step members are not in use, substantially parallel to the surface.

8. The automatic surface-treating apparatus of claim 6 wherein the far periphery extends along an arc of at least 180 degrees.

9. The automatic surface-treating apparatus of claim 1 wherein:

the surface-treating means includes surface-contact members of a first width such that a path of first width is treated as the apparatus traverses the surface on its mobility members; and the side-step members have far peripheries of length less than said first width, whereby one rotation of the side-step members moves the apparatus laterally to a parallel position not beyond the path already treated.

10. The automatic surface-treating apparatus of claim 1 wherein mobility members are wheels, including at least one drive wheel.

11. The automatic surface-treating apparatus of claim 1 further including:

a reversible first drive means linked to at least one of the mobility members;

a second drive means linked to the side-step members; and means to control operation of the drive means thereby to control straight and lateral movements of the apparatus.

12. The automatic surface-treating apparatus of claim 11 wherein the control means comprises programmable control means.

13. The automatic surface-treating apparatus of claim 12 further comprising a control panel including means for digital programming of the apparatus prior to operation.

14. The automatic surface-treating apparatus of claim 12 wherein the first and second drive means include geared motors.

15. The automatic surface-treating apparatus of claim 1 wherein the surface-treating means comprises means for cleaning carpets.

16. The automatic surface-treating apparatus of claim 15 wherein the carpet-cleaning means comprises:

means on the frame for applying foam to carpet on the surface;

a brush movably mounted with respect to the frame in position to stroke the foam through the carpet to loosen carpet soil;

means secured to the frame in position adjacent to the brush to vacuum the foam and loosened carpet soil from the carpet; and at least one cleaning drive means to drive one or more of the foam applying means, brush and vacuum means.

17. The automatic surface-treating apparatus of claim 16 further including:

a reversible first drive means linked to at least one of the mobility members;

a second drive means linked to the side-step members; and means to control operation of the plural drive means thereby to control straight and lateral movements of the apparatus and its cleaning operations.

18. The automatic surface-treating apparatus of claim 17 wherein the control means comprises programmable control means.

19. The automatic surface-treating apparatus of claim 18 further comprising a control panel including means for digital programming of the apparatus prior to operation.

* * * * *

UNITED STATES PATENT AND TRADEMARK OFFICE

CERTIFICATE OF CORRECTION

PATENT NO. : 4,782,550

DATED : November 8, 1988

INVENTOR(S) : Stephen Jacobs

It is certified that error appears in the above-identified patent and that said Letters Patent is hereby corrected as shown below:

Column 1, line 65, change "then" to --than--.

Column 2, line 26, delete "on the".

Column 4, line 21, change "dirve" to --drive--.

Column 5, line 13, change "automaic" to --automatic--.

Column 6, line 45, change "frame 17." to --frame 12.--.

Column 7, line 5, delete "sprocket-".

Column 7, delete lines 6 and 7 completely.

Column 7, line 8, change "producing" to --ing--.

Column 8, line 3, change "programmer" to --programmed--.

Column 8, line 18, change "wil" to --will--.

UNITED STATES PATENT AND TRADEMARK OFFICE

CERTIFICATE OF CORRECTION

PATENT NO. : 4,782,550

DATED : November 8, 1988

INVENTOR(S) : Stephen Jacobs

It is certified that error appears in the above-identified patent and that said Letters Patent is hereby corrected as shown below:

Column 8, line 62, change "decriptions" to --descriptions--.

In claim 5, line 5, change "laterl" to --lateral--.

Signed and Sealed this

Twenty-first Day of March, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,782,550

DATED : November 8, 1988

INVENTOR(S) : Stephen Jacobs

It is certified that error appears in the above-identified patent and that said Letters Patent is hereby corrected as shown below:

Column 1, line 65, change "then" to --than--.

Column 2, line 26, delete "on the".

Column 4, line 21, change "dirve" to --drive--.

Column 5, line 13, change "automaic" to --automatic--.

Column 6, line 45, change "frame 17" to --frame 12--.

Column 7, line 5, delete "sprocket-".

Column 7, delete lines 6 and 7 completely.

Column 8, line 3, change "programmer" to --programmed--.

Column 8, line 18, change "wil" to --will--.

Column 8, line 62, change "decriptions" to --descriptions--.

UNITED STATES PATENT AND TRADEMARK OFFICE

CERTIFICATE OF CORRECTION

PATENT NO. : 4,782,550

DATED : November 8, 1988

INVENTOR(S) : Stephen Jacobs

It is certified that error appears in the above-identified patent and that said Letters Patent is hereby corrected as shown below:

In claim 5, line 5, change "laterl" to --lateral--.

This certificate supersedes Certificate of Correction issued March 21, 1989.

Signed and Sealed this

Nineteenth Day of September, 1989

*Attest:*

DONALD J. QUIGG

*Attesting Officer*

*Commissioner of Patents and Trademarks*